United States Patent [19]

Yagi et al.

[11] 4,120,811

[45] Oct. 17, 1978

[54] SAFE BLEACHING COMPOSITIONS FOR COLORED AND PATTERNED FABRICS

[75] Inventors: Kouichi Yagi, Tokyo; Yunosuke Nakagawa, Koshigaya, both of Japan

[73] Assignee: Kao Soap Co., Ltd., Tokyo, Japan

[21] Appl. No.: 823,271

[22] Filed: Aug. 10, 1977

[30] Foreign Application Priority Data

Sep. 2, 1976 [JP] Japan ..... 51-105277

[51] Int. Cl.[2] ..... C11D 7/56; C11D 7/18; C11D 3/395; D06L 3/02

[52] U.S. Cl. ..... 252/186; 8/107; 8/111; 252/99; 252/102; 260/610 A; 423/272

[58] Field of Search ..... 252/186, 99, 102; 8/107, 111; 423/272, 273; 260/610 A

[56] References Cited

U.S. PATENT DOCUMENTS

| | | | |
|---|---|---|---|
| 3,909,438 | 9/1975 | Nakagawa et al. | 260/610 A |
| 4,046,705 | 9/1977 | Yagi et al. | 252/186 |

*Primary Examiner*—Benjamin R. Padgett
*Assistant Examiner*—Irwin Gluck
*Attorney, Agent, or Firm*—Blanchard, Flynn, Thiel, Boutell & Tanis

[57] ABSTRACT

A bleaching composition comprising 50 to 99.9 wt.% of an inorganic peroxide and 0.01 to 10 wt.% of a compound having the formula:

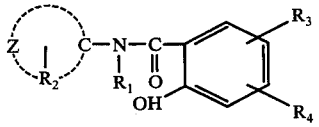

wherein $R_1$ is hydrogen or alkyl having 1 to 3 carbon atoms,

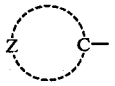

is a radical of a 5 member or 6 member heterocyclic ring system containing only nitrogen and carbon, or nitrogen, oxygen and carbon, atoms in the ring, which can be fused to a benzene ring or another heterocyclic ring to give a polycyclic radical, $R_2$ is hydrogen or substituted or unsubstituted alkyl having 1 to 10 carbon atoms, substituted or unsubstituted phenyl, pyridyl or pyrrolidone group, $R_3$ is hydrogen, substituted or unsubstituted alkyl, phenyl, alkoxy, phenoxy, amino, acyloxy, carbamoyl or acyl group or halogen, or $R_3$ may form together with $R_4$ a benzo radical, and $R_4$ is hydrogen or a monovalent group $—R_5Y$ in which $R_5$ is alkylene or alkylidene having 1 to 6 carbon atoms or a phenylene group and Y is a group corresponding to the residue of the above general formula from which $R_4$ has been removed, or $R_4$ may form a benzo group together with $R_3$.

10 Claims, No Drawings

SAFE BLEACHING COMPOSITIONS FOR COLORED AND PATTERNED FABRICS

BACKGROUND OF THE INVENTION

1. Field of the Invention

The present invention relates to an oxygen-type bleaching composition. More particularly, the invention relates to a bleaching composition which can be used to bleach even a colored or patterned fabric which has been dyed with a metal-containing dye or pigment.

2. Description of the Prior Art

In general, an oxidation reaction is utilized for bleaching operations conducted both in households and industry. Chlorine-type bleaching agents are mainly used for this bleaching reaction. However, many colored and patterned fabrics cannot safely be bleached by these chlorine-type bleaching agents. Accordingly, oxygen-type bleaching agents capable of bleaching even colored and patterned fabrics have recently been developed and used. However, it has been found that the safety of these oxygen-type bleaching agents is insufficient with respect to the bleaching of colored and patterned fabrics dyed with metal-containing dyes or pigments or treated with metal salts or metal-containing fixing agents.

There are known methods in which aminocarboxylic acids and their water-soluble salts such as NTA (nitrilotriacetic acid), EDTA (ethylenediamine tetraacetate) and DTPA (diethylenetriamine pentaacetate), or inorganic salts such as polyphosphates, magnesium salts and silicates are incorporated into oxygen-type bleaching agents so as to stabilize the peroxides in bleaching solutions, to prevent degradation of fluorescent whitening agents and to prevent the fibers of which the fabric is made from becoming brittle. However, when colored and patterned fabrics dyed with metal-containing dyes or pigments or treated with metal salts or metal-containing fixing agents are bleached according to these known methods, there are brought about various disadvantages. For example, no substantial effect can be attained if such additives are not incorporated in very large amounts, or the color tone or hue is changed or degraded in the treated fabrics.

More specifically, a metal chelating agent of the amino acid type such as NTA, EDTA or DTPA has no substantial effect if it is not incorporated in a very large amount. A polyphosphate such as sodium tripolyphosphate, sodium pyrophosphate or sodium hexametaphosphate or a hydroxycarboxylic acid salt, such as sodium citrate, does not exhibit any of the foregoing desired effects at all. Further, a magnesium salt, such as magnesium silicate, rather promotes decoloration and discoloration of colored and patterned fabrics.

The mechanism of decoloration or discoloration in colored and patterned fabrics will now be considered.

These colored and patterned fabrics are dyed by the dipping or printing method. For example, when a woven fabric is dyed with a metal-containing direct dye or a metal-free direct dye, the dyed fabric is ordinarily treated with a metal-free fixing agent or a metal-containing fixing agent or a metal salt so as to improve the swelling or light resistance of the treated fabric. When a woven cotton fabric is dyed according to the printing method, in order to obtain a good swelling resistance and a clear color, a reactive dye containing a metal in the dye molecule is mainly used. Copper, cobalt, chromium and nickel are used as such metal, and the use of copper is most popular. The metal in a colored or patterned fabric dyed according to such method catalytically reacts with hydrogen peroxide in an aqueous bleaching bath to form a hydroxyl radical from hydrogen peroxide, and it is considered that this hydroxyl radical causes discoloration or decoloration of colored and patterned fabrics. This undesirable phenomenon is especially conspicuous when the metal is copper. Therefore, in order to prevent discoloration or decoloration in such colored or patterned fabrics, it is very important to find a chelating agent which is capable of deactivating the metal in the colored or patterned fabric, i.e., completely filling the coordination sites of the metal, so that the metal cannot act as a catalyst for decomposing hydrogen peroxide. The chelating agent as well as metal chelate compounds thereof also should be non-oxidizing and should be capable of coordination with a metal which has already been chelated with the dye.

SUMMARY OF THE INVENTION

We have discovered that when a compound having the formula (I):

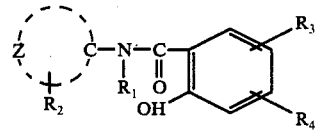

(I)

wherein $R_1$ is hydrogen or alkyl having 1 to 3 carbon atoms;

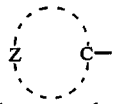

is a 5- or 6-membered monovalent heterocyclic radical which may have a fused ring; $R_2$ is hydrogen, alkyl having 1 to 10 carbon atoms, phenyl, pyridyl or pyrrolidone group, which may optionally be substituted; $R_3$ is hydrogen, halogen, alkyl, phenyl, alkoxy, phenoxy, amino, acyloxy, carbamoyl or acyl group which may optionally be substituted, or $R_3$ together with $R_4$ forms a benzo group; $R_4$ is the same as $R_3$ or it is a monovalent radical having the formula $—R_5Y$, in which $R_5$ is an alkylene or alkylidene group having 1 to 6 carbon atoms or a phenylene group, and Y is a radical formed by removing $R_4$ from a compound of the above formula (I), is incorporated in a bleaching composition comprising an inorganic peroxide as the main component, said inorganic peroxide being capable of supplying hydrogen peroxide when dissolved in water, the decoloration or discoloration of the colored or patterned fabric can be effectively prevented. We have now completed the present invention based on this discovery.

In the formula (I) compound, the 5- or 6-membered heterocyclic ring

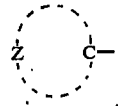

includes heterocyclic rings containing in the ring, in addition to carbon atoms, a nitrogen atom or an oxygen atom and a nitrogen atom. The 5- or 6-membered heterocyclic ring can be fused to a benzene ring or another heterocyclic ring to give a polycyclic radical. As specific examples of 5- or 6-membered heterocyclic rings, there are mentioned triazole, benzotriazole, triazine, tetrazole, tetrazine, imidazole, benzimidazole, indazole, imidazoline, indolenine, pyrazole, benzopyrazole, pyrazolone, pyrazine, pyridazine, pyrimidine, 2-pyrazolone, pyrrolidine, quinoline, quinazoline, isoquinoline, carbazole, pyrrole, pyrrolidine, picoline, isoxazole, oxazole, furazan, piperazine, oxazine, morpholine, pyridine, piperidine, indole, isoindole, indoline, benzoxazole, pyrrolidone, pyrroline and indoxazine.

As specific examples of the substituent $R_2$ on the heterocyclic ring, there can be mentioned hydrogen; alkyls ($C_1$ to $C_{10}$) such as methyl, ethyl, isopropyl and nonyl groups; substituted alkyls ($C_1$ to $C_{10}$) substituted with hydroxy, chloro, amino, alkoxy ($C_1$ to $C_{10}$), phenoxy, phenyl, hydroxyphenyl or benzoylamino such as hydroxyethyl, chloromethyl, aminomethyl, butyroxyethyl, ethoxyethyl, phenoxymethyl, phenylmethyl, p-hydroxyphenylethyl and benzoylaminomethyl groups; phenyl; substituted phenyls wherein the substituents are one or two alkyls ($C_1$ or $C_2$), chloro, hydroxy, alkoxy ($C_1$ to $C_{10}$) acyloxy ($C_1$ to $C_4$) or amino such as toluyl, monochlorophenyl, hydroxyphenyl, alkoxyphenyl, acyloxyphenyl and aminophenyl; aroyl ($C_6$ to $C_8$) such as xylenoyl; pyridyl and pyrrolidone.

As specific examples of the substituent $R_3$ in the formula (I), there can be mentioned hydrogen; alkyl ($C_1$ to $C_{22}$) such as methyl, ethyl, propyl, isopropyl, butyl, hexyl, 2-ethylhexyl, isodecyl, lauryl, palmityl and stearyl; substituted alkyl ($C_1$ to $C_{22}$) wherein the substituents are hydroxy, chloro, alkoxy ($C_1$ to $C_4$), phenoxy, amino or phenyl such as hydroxymethyl, ethoxyethyl, chloromethyl, phenoxymethyl, aminoethyl and phenylmethyl groups; phenyl; substituted phenyl wherein the substituent is one or 2 alkyls having one or 2 carbon atoms or alkoxy ($C_1$ to $C_{10}$) such as toluyl; aroyl ($C_6$ to $C_8$) such as xylenoyl; alkoxy ($C_1$ to $C_{10}$) such as methoxy, butoxy, phenylmethoxy and octoxy groups; phenoxy; halogen such as chlorine and bromine; alkyl ($C_1$ to $C_{10}$) amino groups such as ethylamino; aminosulfonamido; alkanoyloxy ($C_2$ to $C_6$) such as acetoxy; aroyloxy ($C_6$ to $C_8$) oxy such as benzoxy; carbamoyl; and alkoxy ($C_1$ to $C_{10}$) carbonyl and aryl ($C_6$ to $C_8$) oxycarbonyl such as methoxy carbonyl, octyloxy carbonyl and phenoxy carbonyl groups.

The compounds in which $R_3$ and $R_4$ together form a benzo group mean compounds of the formula (I) in which the benzene nucleus shown in the formula (I) is replaced by a naphthalene ring.

The intended objects of the present invention can be attained by the use of any of the compounds having the formula (I). In general, however, better results are obtained by using compounds of the formula (I) in which $R_2$ is hydrogen or methyl, $R_3$ is hydrogen or methyl, $R_4$ is hydrogen or methyl or $R_4$ forms a benzo group together with $R_3$, and

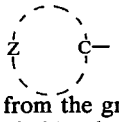

is a member selected from the group consisting of triazole, benzotriazole, imidazole, benzimidazole, tetrazole, indazole, pyrazole, benzopyrazole, triazine, pyridine, picoline, pyrimidine, pyrazine, piperidine and imidazolidone.

The bleaching composition, according to the invention, comprises, in general, from 50 to 99.9 wt.% of an inorganic peroxide capable of supplying hydrogen peroxide when dissolved in aqueous solution. Since the bleaching effect, at the same concentration of the bleaching composition dissolved in the aqueous bleaching liquor, increases as the content of the inorganic peroxide is raised, it is preferred that the content of the inorganic peroxide in the bleaching composition be from 55 to 99 wt.%. In contrast, a comparative composition known as a bleaching detergent composition generally comprises a surface active agent, an inorganic peroxide and a builder as the main components. The content of the inorganic peroxide is ordinarily from 1 to 50 wt.% in such bleaching detergent compositions, although the inorganic peroxide content differs to some extent depending on the kind of inorganic peroxide employed. The bleaching composition, according to the invention, is ordinarily used at a concentration of 0.3 to 1.0% by weight, based on the weight of the aqueous bleaching bath, although the concentration differs to some extent depending on bleaching conditions such as the temperature, the time and the bath ratio. On the other hand, the comparative bleaching detergent composition is ordinarily used at a concentration of 0.05 to 0.2% by weight, based on the weight of the aqueous bleaching detergent bath.

The bleaching composition of the present invention comprises from 50 to 99.9 wt.%, preferably from 55 to 99 wt.%, especially preferably from 70 to 95 wt.%, of an inorganic peroxide capable of releasing hydrogen peroxide in an aqueous solution and from 0.01 to 10 wt.%, preferably from 0.1 to 5 wt.%, especially preferably from 0.5 to 3 wt.%, of a compound or mixture of compounds having the formula (I), with the balance of the composition being a conventional filler or extender such as a neutral or alkaline builder or mixture thereof.

As the inorganic peroxide capable of releasing hydrogen peroxide when dissolved in an aqueous solution, that is used in the present invention, there can be mentioned peroxides and hydrogen peroxide adducts of carbonates, borates, phosphates, sulfates and silicates. As specific compounds, there can be mentioned sodium percarbonate ($2Na_2CO_3.3H_2O_2$), sodium perborate ($NaBO_3.4H_2O$), sodium peroxypyrophosphate ($Na_4P_2O_7.3H_2O_2$), sodium peroxytripolyphosphate and sodium sulfate-sodium chloride-hydrogen peroxide adduct ($Na_2SO_4.NaCl.2H_2O_2$).

As the neutral or alkaline builder, there can be used, for example, water-soluble inorganic builders, e.g., alkali metal sulfates, alkali metal polyphosphates such as tripolyphosphates and pyrophosphates, ortho-phosphates, alkali metal bicarbonates, alkali metal carbonates, and water-soluble silicates. and water-soluble organic builders, e.g., ethylenediamine tetraacetic acid and its salts, tartaric acid salts and citric acid salts. It is preferred to use sodium salts.

Further, anti-redeposition agents such as carboxymethylcellulose, polyvinyl pyrrolidone and polyethylene glycol, inorganic peroxide activating agents such as N-acyl compounds, organic acid anhydrides and esters, and other additives such as various surface active agents, enzymes, fluorescent whitening agents, dyes, pigments and perfumes may be incorporated, in minor amounts, into the bleaching composition of the present invention according to the need.

By the use of the bleaching composition of the present invention, it is possible to bleach colored and patterned fabrics dyed with metal-containing dyes or pigments or treated with metal salts or metal-containing fixing agents, and further, the bleaching effect on stained clothes can be remarkably enhanced.

In the present invention, the compound of the formula (I) can be blended with the inorganic peroxide during the inorganic peroxide-preparing step or it may be added to a bleaching bath separately from the inorganic peroxide.

The present invention will now be further described in detail by reference to the following illustrative examples that by no means limit the scope of the invention. In the examples, all references to "%" and "parts" are by weight.

EXAMPLE 1

Preparation of Dyed Fabric

Cotton cambric fabric was dyed with Color Index Direct Violet 66 (copper-containing direct dye) by the dipping method.

Dyeing Conditions:
Bath ratio: 1/20
Dye concentration: 2.0% o.w.f. (based on the weight weight of fibers)
Temperature: 90° C.
Time: 45 minutes
Anhydrous sodium sulfate: 20% o.w.f. (based on the weight of fibers)

The dyed fabric was washed with water and then the water was removed. Then, the fabric was subjected to the fixing treatment.

Fixing Conditions:
Treating agent: San Fix 555 (metal-free fixing agent manufactured by Sanyo Kasei)
Bath ratio: 1/20
Temperature: 60° C.
Time: 20 minutes
Concentration: 3 g/l The treated fabric was washed with water, water was removed therefrom and the fabric was dried.

Bleaching Test

The resulting dyed fabric was treated under the following conditions. The results shown in Table 1 were obtained.

Composition of Bleaching Agent:

| | | |
|---|---|---|
| $4Na_2SO_4 \cdot NaCl \cdot 2H_2O_2$ | 80 parts | |
| $Na_2CO_3$ | 15 parts | |
| Chelating agent | x parts | (see Table 1) |
| Glauber salt | balance | |
| Total | 100 parts | |

Bleaching Conditions:
Bath ratio: 1/10
Concentration: 1%
Temperature: 50° C.
Time: 30 minutes
Water used: service water Table 1

Discoloration and Decoloration Preventing Effects

| Chelating Agent | Amount (X parts) 5 | 3 | 1 | 0.5 | 0.1 | 0 |
|---|---|---|---|---|---|---|
| Comparison | | | | | | |
| NTA | 3 | — | — | — | — | 1 |
| EDTA | 1 | — | — | — | — | 1 |
| DTPA | 1 | — | — | — | — | 1 |
| Sodium tartrate | 1 | — | — | — | — | 1 |
| Sodium citrate | 1 | — | — | — | — | 1 |
| Sodium tripolyphosphate | 1 | — | — | — | — | 1 |
| Present Invention | | | | | | |
| A | 5 | 5 | 5 | 5 | 5 | 1 |
| B | 5 | 5 | 5 | 5 | 5 | 1 |

Table 1-continued

Discoloration and Decoloration Preventing Effects

| Chelating Agent | Amount (X parts) 5 | 3 | 1 | 0.5 | 0.1 | 0 |
|---|---|---|---|---|---|---|
| A + B (mixed in 1 : 1 wt. ratio) | 5 | 5 | 5 | 5 | 5 | 1 |

Each of the values in Table 1 is a value of the discoloration or decoloration gray scale (determined according to JIS L-0804, 1974).

5: not changed (not decolored)
3: change was observed (slightly decolored)
1: conspicuously changed (decolored substantially completely)

The chelating agents A and B used in this Example are as follows:

Chelating Agent A:
3-Salicyloylamido-1,2,4-triazole of the formula:

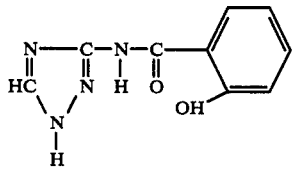

Chelating Agent B:
3-Salicyloylamidobenzimidazole of the formula:

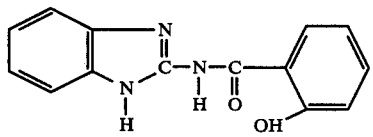

EXAMPLE 2

Preparation of Dyed Fabric

Cotton cambric fabric was dyed with Color Index Direct Blue 248 (metal-free direct dye) by the dipping method.

Dyeing Conditions:
Bath ratio: 1/20
Dye concentration: 4.0% o.w.f.
Temperature: 90° C.
Time: 45 minutes
Anhydrous sodium sulfate: 30% o.w.f.
Sodium carbonate: 1% o.w.f.

The dyed fabric was washed with water and then water was removed. Then, the fabric was subjected to the fixing treatment.

Fixing Conditions:
Treating agent: San Fix 555C (copper-containing fixing agent manufactured by Sanyo Kasei)
Concentration: 3 g/l
Bath ratio: 1/20
Temperature: 60° C.
Time: 20 minutes The treated fabric was washed with water, water was removed therefrom and the fabric was dried.

Bleaching Test

The resulting dyed fabric was treated under the following conditions and the results shown in Table 2 were obtained.

Composition of Bleaching Agent:

| | |
|---|---|
| $NaBO_4 \cdot 4H_2O$ | 85 parts |
| Sodium tripolyphosphate | 5 parts |
| Chelating agent | X parts (see Table 2) |
| Glauber salt | balance |
| Total | 100 parts |

Bleaching Conditions:
Bath ratio: 1/10
Concentration: 0.5%
Temperature: 40° C.
Time: 30 minutes
Water used: service water Table 2

| Discoloration and Decoloration Preventing Effects | | | | | | |
|---|---|---|---|---|---|---|
| | Amount (X parts) | | | | | |
| Chelating Agent | 10 | 5 | 3 | 1 | 0.1 | 0 |
| Comparison | | | | | | |
| L-Histidine | 2 | — | — | — | — | 1 |
| L-Proline | 1 | — | — | — | — | 1 |
| Glycine | 1 | — | — | — | — | 1 |
| β-Alanine | 1 | — | — | — | — | 1 |
| L-Arginine | 1 | — | — | — | — | 1 |
| Present Invention | | | | | | |
| A | 5 | 5 | 5 | 5 | 5 | 1 |
| C | 5 | 5 | 5 | 5 | 4–5 | 1 |
| D | 5 | 5 | 5 | 5 | 4–5 | 1 |

Each of the values in Table 2 has the same meaning as described in Example 1.

The chelating agent A used in this Example is the same compound as the chelating agent A used in Example 1. Chelating agents C and D used in this Example are as follows:

5-Salicyloylamido-1,2,3,4-tetrazole of the formula:

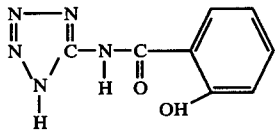

Chelating Agent D:

2-Salicyloylamido-1,3-imidazole of the formula:

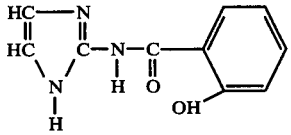

EXAMPLE 3

Preparation of Dyed Fabric

Cotton cambric fabric was dyed with Color Index Reactive Blue 13 (copper-containing reactive dye) by the dipping method.

Dyeing Conditions:
Bath ratio: 1/20
Dye concentration: 2.0% o.w.f.
Temperature: 80° C.
Time: 90 minutes
Glauber salt: 80 g/l (added at the start of the dyeing treatment)
Soda ash: 20 g/l (added 30 minutes after Glauber salt was added)

After the dyeing treatment, the dyed fabric was subjected to water-washing, warm water-washing, soaping, water-washing and drying. The soaping treatment was carried out for 15 minutes in a boiled aqueous solution containing Emar 10 (alkyl sulfate type detergent) at a concentration of 2 g/l.

Bleaching Test

The resulting dyed fabric was treated under the following conditions and the results shown in Table 3 were obtained.

Composition of Bleaching Agent:

| | |
|---|---|
| $2Na_2CO_3 \cdot 3H_2O_2$ | 85 parts |
| $Na_3CO_3$ | 5 parts |
| Chelating agent | x parts (see Table 3) |
| Glauber salt | balance |
| Total | 100 parts |

Bleaching Conditions:
Bath ratio: 1/10
Concentration: 0.5%
Temperature: 25° C.
Time: 15 hours
Water used: service water Table 3

| Discoloration and Decoloration Preventing Effects | | | | | |
|---|---|---|---|---|---|
| | Amount (X parts) | | | | |
| Chelating Agent | 5 | 3 | 1 | 0.1 | 0 |
| Comparison | | | | | |
| 2,2'-Bipyridyl | 1 | — | — | — | 1 |
| Oxine | 2 | — | — | — | 1 |
| Salicylaldoxime | 4 | — | — | — | 1 |
| α-benzoinoxime | 1 | — | — | — | 1 |
| 1,10-Phenanthrolene | 1 | — | — | — | 1 |
| Cupferron | 1 | — | — | — | 1 |
| Present Invention | | | | | |
| A | 5 | 5 | 5 | 5 | 1 |
| E | 5 | 5 | 5 | 5 | 1 |
| F | 5 | 5 | 5 | 5 | 1 |
| G | 5 | 5 | 5 | 5 | 1 |

Each of the values in Table 3 has the same meaning as described in Example 1.

The chelating agent A used in this Example was the same compound as the chelating compound A used in Example 1. Chelating agents E, G and F used in this Example are as follows:

Chelating Agent E:

3-Salicyloylamido-1,2-pyrazole of the formula:

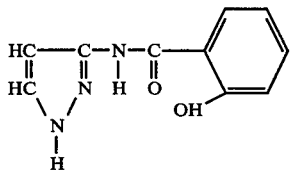

Chelating Agent F:

3-Salicyloylamido-1,2-benzopyrazole of the formula:

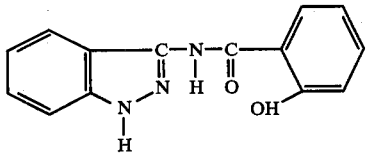

Chelating Agent G:

3-(2-hydroxy-3-naphtoyl)amido-1,2,4-triazole of the formula:

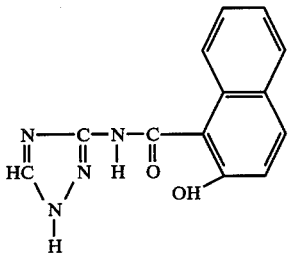

EXAMPLE 4

Bleaching compositions (i), (ii), (iii), and (iv) described below were prepared. A black tea-stained cloth was dipped in an aqueous solution containing 1% of the thus-formed composition (i), (ii), (iii) or (iv) at 40° C. for 30 minutes to effect bleaching. The bleached cloth was washed with service water, air-dried and ironed. The reflectivity was measured by using an automatic color difference meter and the bleaching power was calculated according to the following formula:

Bleaching Power = (550 mμ reflectivity of bleached cloth) - (550 mμ reflectivity of stained cloth before the treatment)

In the above calculation, the reflectivity at 550 mμ of stained cloth before the treatment was adjusted to 42 + 1%.

The results are shown in Table 4.

| Bleaching Composition (parts) | Composition | | | |
|---|---|---|---|---|
| Components | (i) | (ii) | (iii) | (iv) |
| $2Na_2CO_3 \cdot 3H_2O_2$ | 90 | 90 | 90 | 90 |
| $Na_2CO_3$ | 5 | 5 | 5 | 5 |
| Glauber Salt | 5 | 4 | 4 | 4 |
| Chelating Agent A | — | 1 | — | — |
| Chelating Agent B | — | — | 1 | — |
| Chelating Agent C | — | — | — | 1 |
| Note | Control | Present Invention | Present Invention | Present Invention |

Table 4

| Bleaching Power | |
|---|---|
| Bleaching Composition | Bleaching Power |
| (i) | 29.5 |
| (ii) | 33.0 |
| (iii) | 32.8 |
| (iv) | 32.5 |

The embodiments of the invention in which an exclusive property or privilege is claimed are defined as follows:

1. A bleaching composition consisting essentially of from 50 to 99.9 percent by weight of inorganic peroxide capable of releasing hydrogen peroxide in aqueous solution, from 0.01 to 10 percent by weight of a compound having the formula (I):

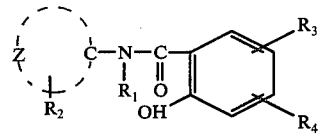

(I)

wherein $R_1$ is hydrogen or alkyl having one to 3 carbon atoms,

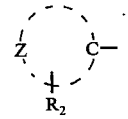

is 5- or 6-membered heterocyclic radical which may have a fused ring; $R_2$ is hydrogen, alkyl having one to 10 carbon atoms, phenyl, pyridyl or pyrrolidone, which may optionally be substituted; $R_3$ is hydrogen, halogen, alkyl, phenyl, alkoxy, phenoxy, amino, acyloxy, carbamoyl or acyl which may optionally be substituted, or $R_3$ may form a benzo group together with $R_4$; $R_4$ is the same as $R_3$ or a monovalent radical having the formula $-R_5Y$ wherein $R_5$ is an alkylene or alkylidene group having 1 to 6 carbon atoms or phenylene, and Y is a radical formed by removing $R_4$ from a compound of the formula (1)

and the balance is essentially water-soluble inorganic builder, water-soluble organic builder or mixture thereof.

2. A bleaching composition according to claim 1 which comprises from 55 to 99 percent by weight of said inorganic peroxide and from 0.1 to 5 percent by weight of said formula (I) compound.

3. A bleaching composition acccording to claim 2 wherein the amount of said formula (I) compound is from 0.5 to 3 percent by weight.

4. A bleaching composition according to claim 1 wherein $R_2$ is hydrogen or methyl.

5. A bleaching composition according to claim 1 wherein $R_3$ and $R_4$ each is hydrogen or methyl or together they form a benzo group.

6. A bleaching composition according to claim 1 wherein

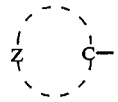

is a member selected from the group consisting of triazole, benzotriazole, imidazole, benzimidazole, tetrazole, indazole, pyrazole, benzopyrazole, triazine, pyridine, picoline, pyrimidine, pyrazine, piperidine and imidazolidone.

7. A bleaching composition according to claim 6 wherein

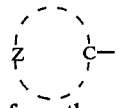

is a member selected from the group consisting of triazole, imidazole, benzimidazole, tetrazole, pyrazole and benzopyrazole.

8. An aqueous bleaching solution consisting essentially of from 0.3 to 1.0 percent by weight of a composition as claimed in claim 1 and the balance is essentially water.

9. A process of bleaching fabric which comprises immersing the fabric in an aqueous bleaching solution as claimed in claim 8 for a period of time effective to bleach the fabric.

10. A bleaching composition as claimed in claim 1, consisting essentially of:

A. from about 70 to about 95 percent by weight of an inorganic peroxygen compound capable of releasing oxygen in aqueous solution;

B. from about 0.5 to about 3.0 percent by weight of a compound or mixture of compounds having the formula

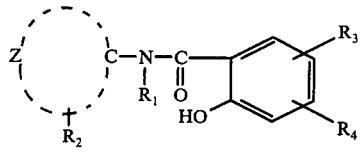

wherein $R_1$ is hydrogen or alkyl having one to 3 carbon atoms;

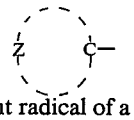

is a monovalent radical of a 5 member or 6 member heterocyclic ring containing only nitrogen and carbon atoms, or nitrogen, oxygen and carbon atoms, in the ring, or said heterocyclic ring fused to a benzene ring or another heterocyclic ring to give a polycyclic radical; $R_2$ is hydrogen, unsubstituted alkyl having one to 10 carbon atoms, alkyl having one to 10 carbon atoms substituted with hydroxy, chloro, amino, alkoxy ($C_1$ to $C_{10}$), phenoxy, phenyl, hydroxyphenyl or benzoylamino, unsubstituted phenyl, phenyl substituted with one or two alkyls ($C_1$ to $C_2$), chloro, hydroxy, alkoxy ($C_1$ to $C_{10}$), acyloxy ($C_1$ to $C_4$) or amino, aroyl having 6 to 8 carbon atoms, pyridyl or pyrrolidone; $R_3$ is hydrogen, unsubstituted alkyl having one to 22 carbon atoms, alkyl having one to 22 carbon atom substituted with hydroxy, chloro, alkoxy ($C_1$ to $C_4$), phenoxy, phenyl or amino, phenyl, phenyl substituted with one or 2 alkyls having one or 2 carbon atoms or alkoxy ($C_1$ to $C_{10}$), aroyl having 6 to 8 carbon atoms, alkoxy having one to 10 carbon atoms, phenoxy, halogen, alkylamino ($C_1$ to $C_{10}$), aminosulfonamido, alkanoyloxy ($C_2$ to $C_6$), aroyloxy ($C_6$ to $C_8$), carbamoyl, alkoxy ($C_1$ to $C_{10}$) carbonyl and aryl ($C_6$ to $C_8$) oxycarbonyl, or $R_3$ and $R_4$ together form a benzo group; and $R_4$ is hydrogen or $-R_5Y$, in which $R_5$ is alkylene having one to 6 carbons, alkylidene having one to 6 carbons or phenylene, and Y is a radical obtained by removing $R_4$ from a compound of said formula, and C. the balance is a substance or mixture of substances selected from the group consisting of water-soluble neutral inorganic builder salts, water-soluble alkaline inorganic builder salts and water-soluble organic builders.

* * * * *